US010738451B2

(12) United States Patent
Terada et al.

(10) Patent No.: US 10,738,451 B2
(45) Date of Patent: Aug. 11, 2020

(54) WATER STORAGE TANK, HOT WATER STORAGE-TYPE HEAT EXCHANGER, AND SANITARY WASHING DEVICE

(71) Applicant: TOTO LTD., Kitakyushu-shi, Fukuoka (JP)

(72) Inventors: Yutaro Terada, Kitakyushu (JP); Yoshiharu Mitsuhashi, Kitakyushu (JP); Nobuhiko Umeda, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 2 days.

(21) Appl. No.: 16/250,004

(22) Filed: Jan. 17, 2019

(65) Prior Publication Data

US 2019/0292761 A1 Sep. 26, 2019

(30) Foreign Application Priority Data

Mar. 23, 2018 (JP) ..... 2018-055680

(51) Int. Cl.
*E03D 9/08* (2006.01)
*F24H 7/00* (2006.01)

(52) U.S. Cl.
CPC ..... *E03D 9/08* (2013.01); *F24H 7/00* (2013.01)

(58) Field of Classification Search
CPC ..... E03D 9/08; F24H 7/00
USPC ..... 4/420
See application file for complete search history.

(56) References Cited

U.S. PATENT DOCUMENTS

| | | | | |
|---|---|---|---|---|
| 5,421,039 | A * | 6/1995 | Hirashiba | E03D 9/08 4/420.2 |
| 5,911,516 | A * | 6/1999 | Chang | E03D 9/08 4/420.2 |
| 6,430,366 | B1 * | 8/2002 | Mizutani | E03D 9/08 392/449 |
| 6,649,884 | B2 * | 11/2003 | Nonomura | E03D 9/08 219/494 |
| 2006/0118358 | A1 | 6/2006 | Vollrath | |

FOREIGN PATENT DOCUMENTS

| | | | |
|---|---|---|---|
| JP | H09-195360 | A | 7/1997 |
| JP | 2000-144856 | A | 5/2000 |
| JP | 2008-075426 | A | 4/2008 |

OTHER PUBLICATIONS

English translation of Japanese Publication No. 2001-272109, dated Oct. 5, 2011 in the name of TOTO LTD.

* cited by examiner

*Primary Examiner* — Huyen D Le
(74) *Attorney, Agent, or Firm* — Pearne & Gordon LLP

(57) ABSTRACT

According to one embodiment, water storage tank has a space in an interior of the water storage tank. Water is stored in the space. The tank includes a lower enclosure, an upper enclosure, and a bonding member. The upper enclosure is positioned on the lower enclosure. The space is formed by the upper enclosure being bonded to the lower enclosure. The upper enclosure is longer than the lower enclosure in a vertical direction. The bonding member bonds the lower enclosure and the upper enclosure and is positioned between the lower enclosure and the upper enclosure. The lower enclosure has a concave part provided on the space side of the bonding member. The upper enclosure has a convex part provided on the space side of the bonding member. The convex part is engaged with the concave part.

6 Claims, 5 Drawing Sheets

WATER STORAGE TANK, HOT WATER STORAGE-TYPE HEAT EXCHANGER, AND SANITARY WASHING DEVICE

CROSS-REFERENCE TO RELATED APPLICATIONS

This application is based upon and claims the benefit of priority from Japanese Patent Application No. 2018-055680, filed on Mar. 23, 2018; the entire contents of which are incorporated herein by reference.

FIELD

Embodiments described herein relate generally to a water storage tank, a hot water storage-type heat exchanger, and a sanitary washing device.

BACKGROUND

To downsize a sanitary washing device and improve its designability, the downsizing of a water storage tank of a hot water storage-type heat exchanger used in the sanitary washing device is being considered. Conventionally, the water storage tank has been manufactured by vibration welding in which an upper enclosure and a lower enclosure are welded by vibrations. In this method, it is necessary to provide a stroke at the bonding part to vibrate and bond the upper enclosure and the lower enclosure; and it is difficult to downsize the water storage tank. Therefore, a manufacturing method that uses die slide injection (DSI) molding may be considered (JP-A 2008-75426 (Kokai)).

In the manufacturing method using DSI molding, the upper enclosure and the lower enclosure are molded (preliminary molding); subsequently, the dies are caused to slide to align the positions of the upper enclosure and the lower enclosure; and the upper enclosure and the lower enclosure are bonded (secondary molding) by injecting a bonding member between the upper enclosure and the lower enclosure. A stroke is unnecessary in the manufacturing method using DSI molding; therefore, it is easier to downsize the water storage tank than by a manufacturing method using vibration welding.

DETAILED DESCRIPTION

Figure 1:
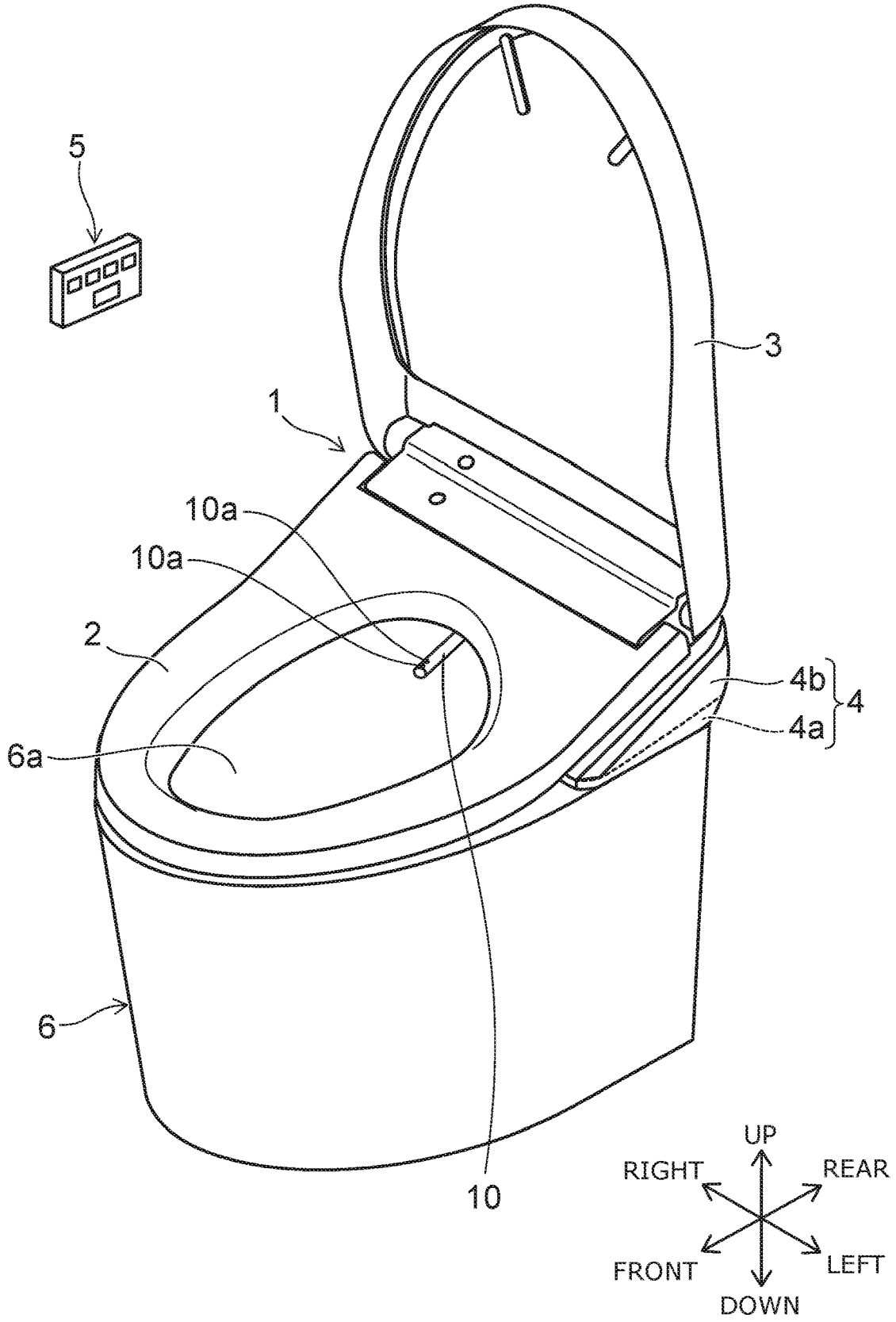
FIG. 1 is a perspective view schematically illustrating a toilet device including a sanitary washing device according to an embodiment.

A first invention is a water storage tank having a space in an interior of the water storage tank; water is stored in the space; the water storage tank includes a lower enclosure, an upper enclosure positioned on the lower enclosure, and a bonding member bonding the lower enclosure and the upper enclosure; the upper enclosure is longer than the lower enclosure in a vertical direction; the space is formed by the upper enclosure being bonded to the lower enclosure; the bonding member is positioned between the lower enclosure and the upper enclosure; the lower enclosure has a concave part provided on the space side of the bonding member; the upper enclosure has a convex part provided on the space side of the bonding member; and the convex part is engaged with the concave part.

According to the water storage tank, the convex part of the upper enclosure is engaged with the concave part of the lower enclosure at a position on the space side of (inward from) the bonding member. Thereby, in the case where water pressure is applied from the tank interior, the concentration of stress at the bonding member can be suppressed. Also, by providing the concave part in the lower enclosure which has a higher rigidity than the upper enclosure, the engaging part does not deform easily; therefore, the concentration of the stress at the bonding member can be suppressed further. Accordingly, breakage of the bonding member due to the water pressure from the tank interior can be suppressed in the water storage tank manufactured by DSI molding.

A second invention is the water storage tank of the first invention, wherein a length in the vertical direction of the convex part is longer than a distance between the bonding member and a lower edge of an inner surface of the upper enclosure.

According to the water storage tank, the engaging part does not deform easily because the length in the vertical direction of the convex part is set to be long. Therefore, the breakage of the bonding member due to the water pressure from the tank interior can be suppressed further in the water storage tank manufactured by DSI molding.

A third invention is the water storage tank of the first or second invention, wherein the upper enclosure includes a bonding part to be bonded to the bonding member; and a surface area from a lower edge of an inner surface of the upper enclosure to the bonding part is greater than a surface area of the bonding part.

According to the water storage tank, the surface area of the region from the lower edge of the inner surface of the upper enclosure to the bonding part (the region inward from the bonding part) is set to be greater than the surface area of the bonding part; thereby, the region that is inward from the bonding part can be cured faster than the bonding part in the preliminary molding of the DSI molding. Also, the density of the bonding member that is injected can be set to be high. Accordingly, the breakage of the bonding member due to the water pressure from the tank interior can be suppressed further in the water storage tank manufactured by DSI molding.

A fourth invention is the water storage tank of any one of the first to third inventions, wherein the lower enclosure includes a first protruding part protruding away from the space from an upper edge of an outer surface of the lower enclosure; the upper enclosure includes a second protruding part protruding away from the space from a lower edge of an outer surface of the upper enclosure; and the bonding member overlaps an imaginary line connecting the upper edge of the outer surface of the lower enclosure and the lower edge of the outer surface of the upper enclosure.

According to the water storage tank, a good balance can be achieved between the reduction of the stress applied to the bonding member when water pressure is applied from the tank interior and the suppression of the deformation of the lower enclosure and the upper enclosure when injecting the bonding member in the secondary molding of the DSI molding. Therefore, the breakage of the bonding member due to the water pressure from the tank interior can be suppressed further in the water storage tank manufactured by DSI molding.

A fifth invention is a hot water storage-type heat exchanger that includes the water storage tank of any one of the first to fourth inventions, and includes a heater heating the water inside the water storage tank.

According to the hot water storage-type heat exchanger, water leakage that is caused by breakage of the bonding member of the water storage tank can be suppressed.

A sixth invention is a sanitary washing device that includes the hot water storage-type heat exchanger of the fifth invention, and includes a casing storing the hot water storage-type heat exchanger.

According to the sanitary washing device, water leakage outside the casing caused by breakage of the bonding member of the water storage tank can be suppressed.

Various embodiments are described below with reference to the accompanying drawings. Similar components in the drawings are marked with the same reference numerals, and a detailed description is omitted as appropriate.

FIG. 1 is a perspective view schematically illustrating a toilet device including a sanitary washing device according to an embodiment.

As illustrated in FIG. 1, the toilet device includes a western-style sit-down toilet (for convenience of description hereinbelow, called simply the "toilet") 6 and the sanitary washing device 1 provided on the toilet 6. The sanitary washing device 1 includes a toilet seat 2, a toilet lid 3, and a casing 4. The toilet seat 2 and the toilet lid 3 each are pivotally supported openably and closeably with respect to the casing 4.

Although "up," "down," "front," "rear," "right," and "left" are used in the description of the embodiments recited below, these directions are when viewed by a user sitting on the toilet seat 2 as illustrated in FIG. 1.

The casing 4 includes a case plate 4*a* placed on the upper surface of the rear of the toilet 6, and a cover 4*b* covering the case plate 4*a*. The case plate 4*a* is illustrated by a broken line in the example illustrated in FIG. 1 because the case plate 4*a* is hidden by being covered with the cover 4*b*.

A nozzle 10 that washes the "bottom" or the like of the user sitting on the toilet seat 2 is built into the interior of the casing 4. Also, a hot water storage-type heat exchanger 20 that heats and stores warm water (hot water) to be dispensed from the nozzle 10 is stored in the interior of the casing 4. Also, for example, a room entrance detection sensor that detects the user entering the toilet room, a human body detection sensor that detects the user in front of the toilet seat 2, a seat contact detection sensor that detects the user seated on the toilet seat 2, etc., are provided in the casing 4.

By operating an operation part 5 such as a remote control, etc., the user can cause the nozzle 10 to advance into a bowl 6*a* of the toilet 6 and retract from the interior of the bowl 6*a*. In the sanitary washing device 1 illustrated in FIG. 1, the nozzle 10 is illustrated in the state of being advanced into the bowl 6*a*.

The nozzle 10 has a water discharge port 10*a* at a tip of the nozzle 10. For example, the warm water (the hot water) that is heated and stored in the hot water storage-type heat exchanger 20 is dispensed from the water discharge port 10*a* of the nozzle 10. A private part of the user is washed by discharging the warm water toward the private part from the water discharge port 10*a* in the state in which the nozzle 10 is advanced into the bowl 6*a*.

Also, a "toilet seat heater" that warms the toilet seat 2, a "warm air drying function" that dries the "bottom" or the like of the user sitting on the toilet seat 2 by blowing warm air toward the "bottom" or the like, a "deodorizing unit," a "room heating unit," etc., may be appropriately provided in the casing 4.

Figure 2:
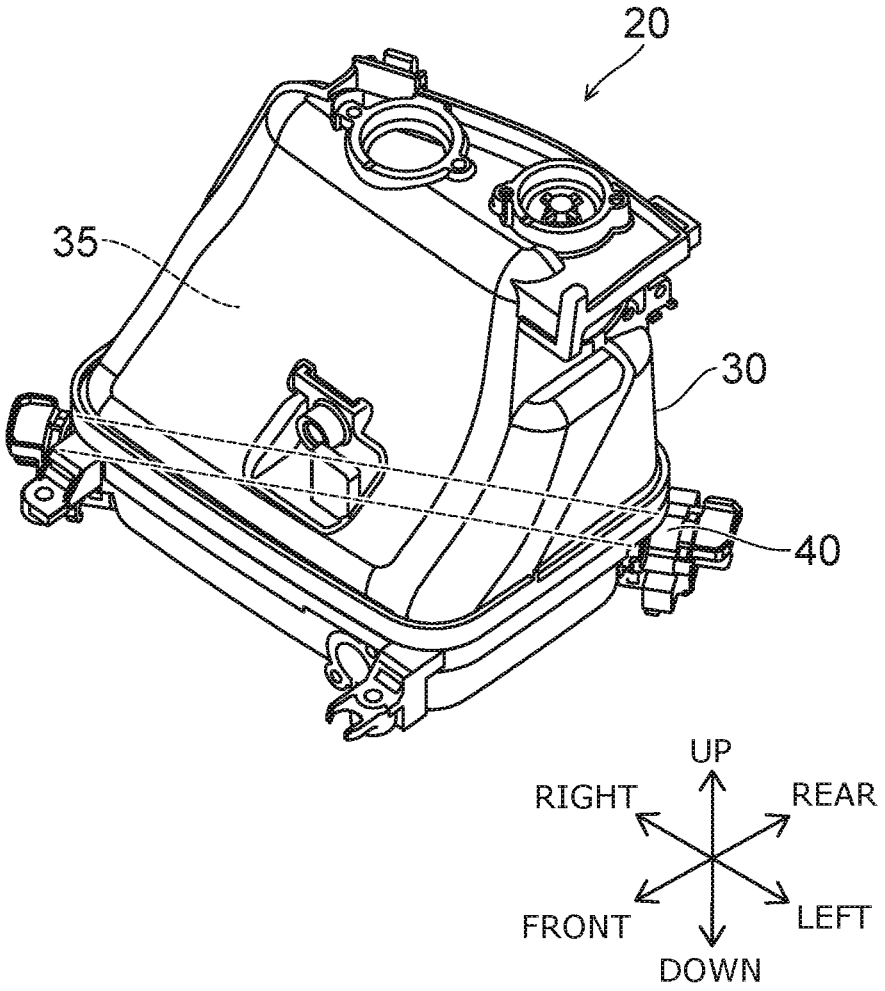
FIG. 2 is a perspective view schematically illustrating the hot water storage-type heat exchanger according to the embodiment.

FIG. 2 is a perspective view schematically illustrating the hot water storage-type heat exchanger according to the embodiment.

As illustrated in FIG. 2, the hot water storage-type heat exchanger 20 includes a water storage tank 30 and a heater 40.

The water storage tank 30 has a hollow configuration. Water or hot water is stored in a space 35 in the interior of the water storage tank 30. For example, the water storage tank 30 is made of a resin such as nylon, etc. In the example, the upper part of the front surface of the water storage tank 30 is tilted to match the casing 4 of which the front surface (the upper surface) is tilted. The configuration of the water storage tank 30 is not limited thereto and is modifiable as appropriate to match the configuration of the casing 4. The structure of the water storage tank 30 is described below.

The heater 40 is disposed in the interior of the water storage tank 30, heats the water stored in the space 35 in the interior of the water storage tank 30, and turns the water into hot water. For example, the heater 40 is provided to be aligned with the bottom surface part of the interior of the water storage tank 30. For example, the heater 40 has a rod configuration. For example, the heater 40 is provided to obliquely pierce the water storage tank 30. More specifically, the two end parts of the heater 40 pierce through-holes formed in the water storage tank 30 and are exposed outside the water storage tank 30 at the through-holes. Then, the heater 40 is mounted watertightly to the parts where the heater 40 pierces the water storage tank 30 by sealing members such as, for example, O-rings, etc. The heater 40 is, for example, a sheathed heater.

Figure 3A:
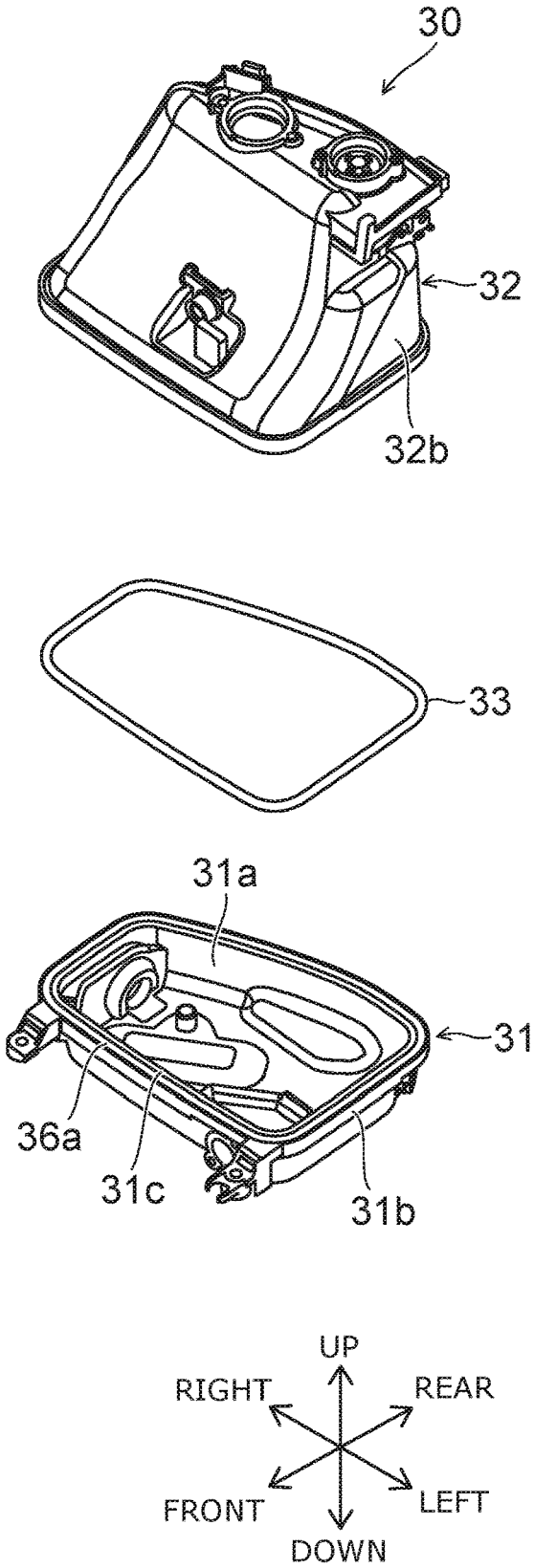
FIG. 3A and FIG. 3B are exploded perspective views schematically illustrating the water storage tank according to the embodiment.
Figure 3B:
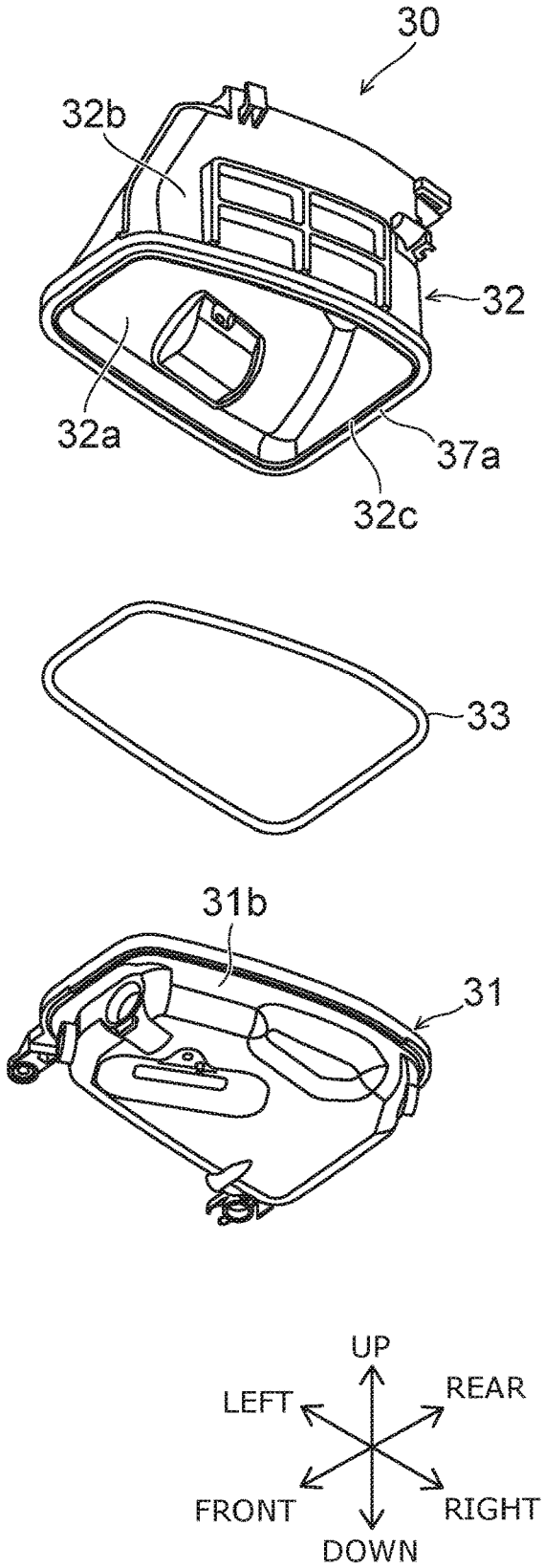

FIG. 3A and FIG. 3B are exploded perspective views schematically illustrating the water storage tank according to the embodiment.

FIG. 3A is an exploded perspective view as viewed from above. FIG. 3B is an exploded perspective view as viewed from below.

As illustrated in FIG. 3A and FIG. 3B, the water storage tank 30 includes a lower enclosure 31, an upper enclosure 32, and a bonding member 33. The lower enclosure 31 and the upper enclosure 32 are bonded by the bonding member 33.

The lower enclosure 31 is an enclosure positioned at the lower part of the water storage tank 30. The lower enclosure 31 is open upward and includes a first inner surface 31*a*, a first outer surface 31*b*, and a first rim part 31*c*. The first inner surface 31*a* is a surface forming the space 35 in the interior of the water storage tank 30. The first outer surface 31*b* is a surface exposed at the exterior of the water storage tank 30. The first rim part 31*c* is a rim surrounding the periphery of the opening of the lower enclosure 31. The first rim part 31*c* is bonded to the upper enclosure 32 via the bonding member 33. The first rim part 31*c* includes a first bonding part 36*a* to be bonded to the bonding member 33. The first bonding part 36*a* is provided to surround the periphery of the opening of the lower enclosure 31. In other words, the first bonding part 36*a* is provided at the entire perimeter of the first rim part 31*c*.

The upper enclosure 32 is an enclosure positioned at the upper part of the water storage tank 30. The upper enclosure 32 is provided on the lower enclosure 31. The upper enclosure 32 is open downward and includes a second inner surface 32*a*, a second outer surface 32*b*, and a second rim part 32*c*. The second inner surface 32*a* is a surface forming the space 35 in the interior of the water storage tank 30. The second outer surface 32*b* is a surface exposed at the exterior of the water storage tank 30. The second rim part 32*c* is a rim surrounding the periphery of the opening of the upper enclosure 32. The second rim part 32*c* is bonded to the lower enclosure 31 via the bonding member 33. The second rim part 32*c* includes a second bonding part 37*a* to be bonded to the bonding member 33. The second bonding part 37*a* is provided to surround the periphery of the opening of the upper enclosure 32. In other words, the second bonding part 37*a* is provided at the entire perimeter of the second rim part 32*c*.

The bonding member 33 is provided between the lower enclosure 31 and the upper enclosure 32 and bonds the lower enclosure 31 and the upper enclosure 32. More specifically, the bonding member 33 is provided between the first bonding part 36*a* of the first rim part 31*c* of the lower enclosure 31 and the second bonding part 37*a* of the second rim part 32*c* of the upper enclosure 32 and bonds the first bonding part 36*a* and the second bonding part 37*a*. The bonding member 33 is provided to surround the peripheries of the opening of the lower enclosure 31 and the opening of the upper enclosure 32. The bonding member 33 is provided at the entire perimeter along the first bonding part 36*a* and the second bonding part 37*a*. In other words, the bonding member 33 bonds the entire perimeter of the first bonding part 36*a* and the entire perimeter of the second bonding part 37*a*.

The first rim part 31*c* (the first bonding part 36*a*) of the lower enclosure 31 and the second rim part 32*c* (the second bonding part 37*a*) of the upper enclosure 32 are sealed to each other by the first rim part 31*c* and the second rim part 32*c* being bonded by the bonding member 33. The space 35 in which the water or the hot water can be stored is formed by the first inner surface 31*a* of the lower enclosure 31 and the second inner surface 32*a* of the upper enclosure 32.

Figure 4:
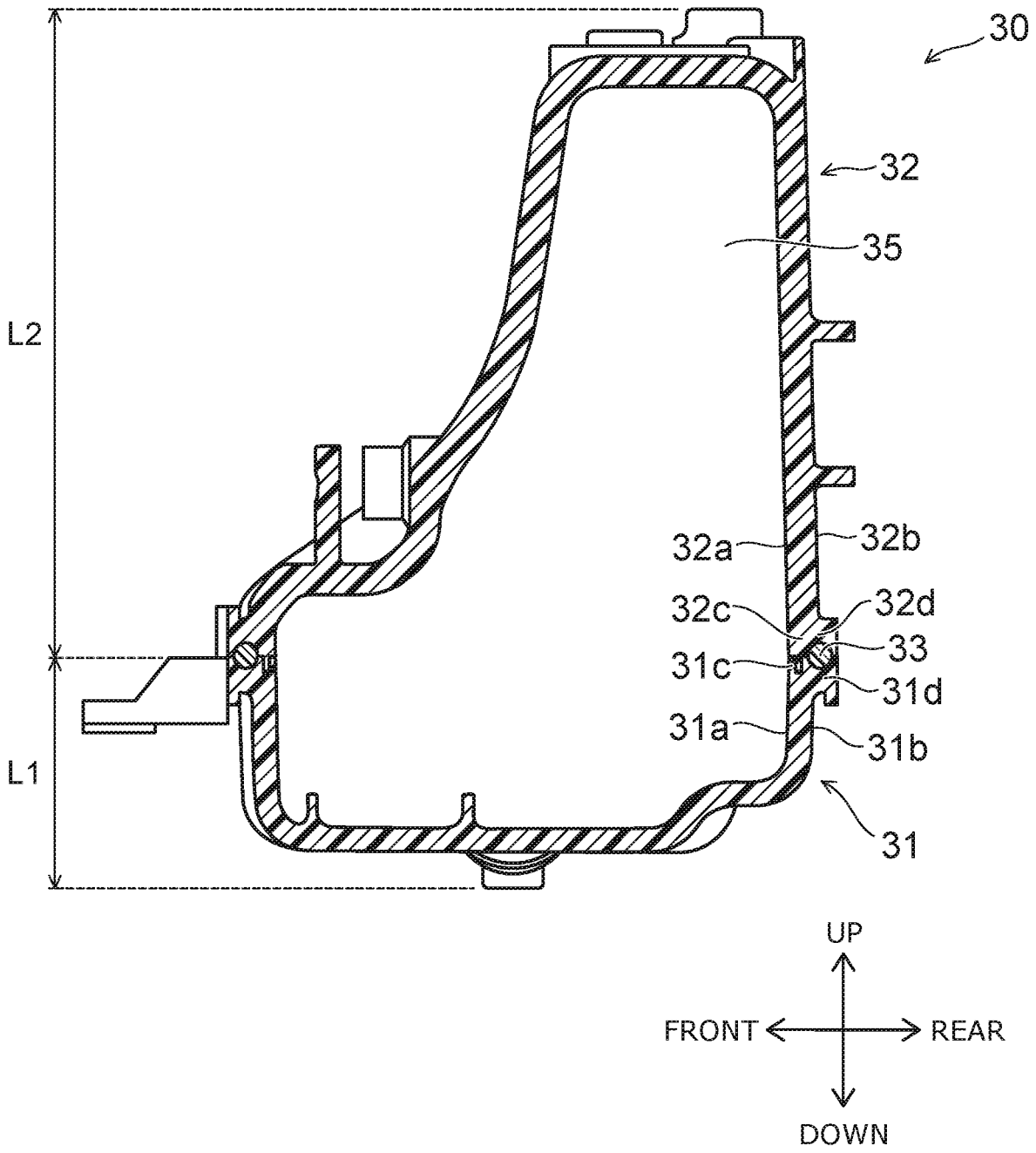
FIG. 4 is a cross-sectional view schematically illustrating the water storage tank according to the embodiment.

A length L2 in the vertical direction of the upper enclosure 32 (referring to FIG. 4) is longer than a length L1 in the vertical direction of the lower enclosure 31 (referring to FIG. 4). For example, the first rim part 31*c* of the lower enclosure 31 and the second rim part 32*c* of the upper enclosure 32 are positioned lower than the center of the water storage tank 30 in the vertical direction. For example, the bonding member 33 is positioned lower than the center of the water storage tank 30 in the vertical direction. The rigidity of the lower enclosure 31 is higher than the rigidity of the upper enclosure 32. That is, the lower enclosure 31 deforms less easily than the upper enclosure 32.

FIG. 4 is a cross-sectional view schematically illustrating the water storage tank according to the embodiment.

Figure 5A:
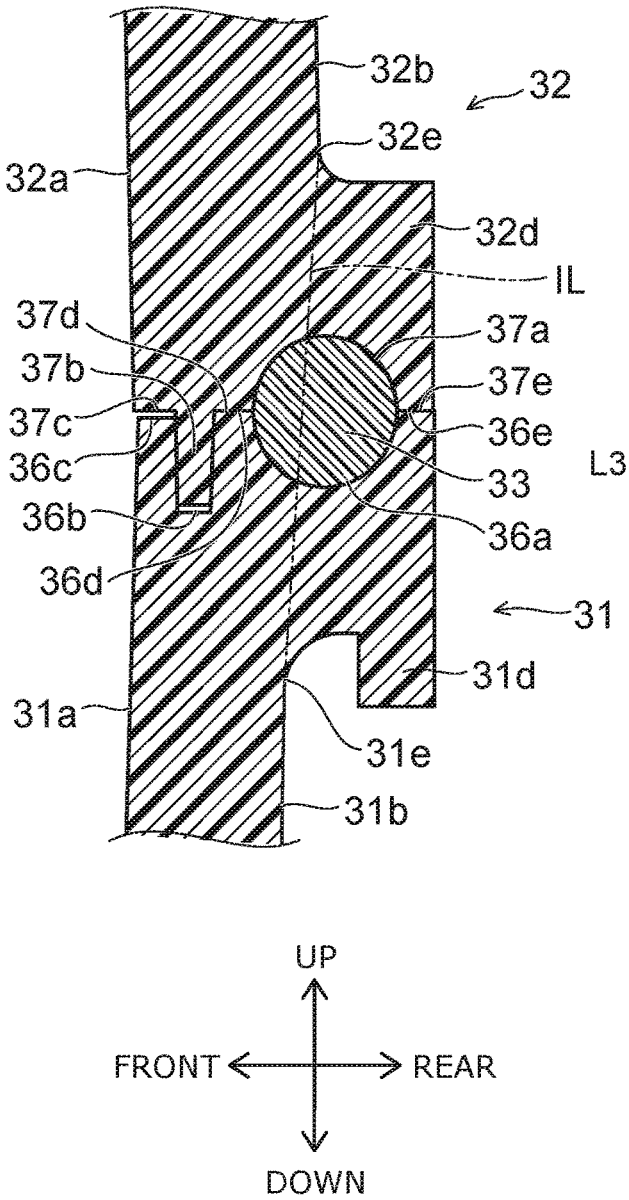
FIG. 5A and FIG. 5B are cross-sectional views schematically illustrating an enlargement of a part of the water storage tank according to the embodiment.
Figure 5B:
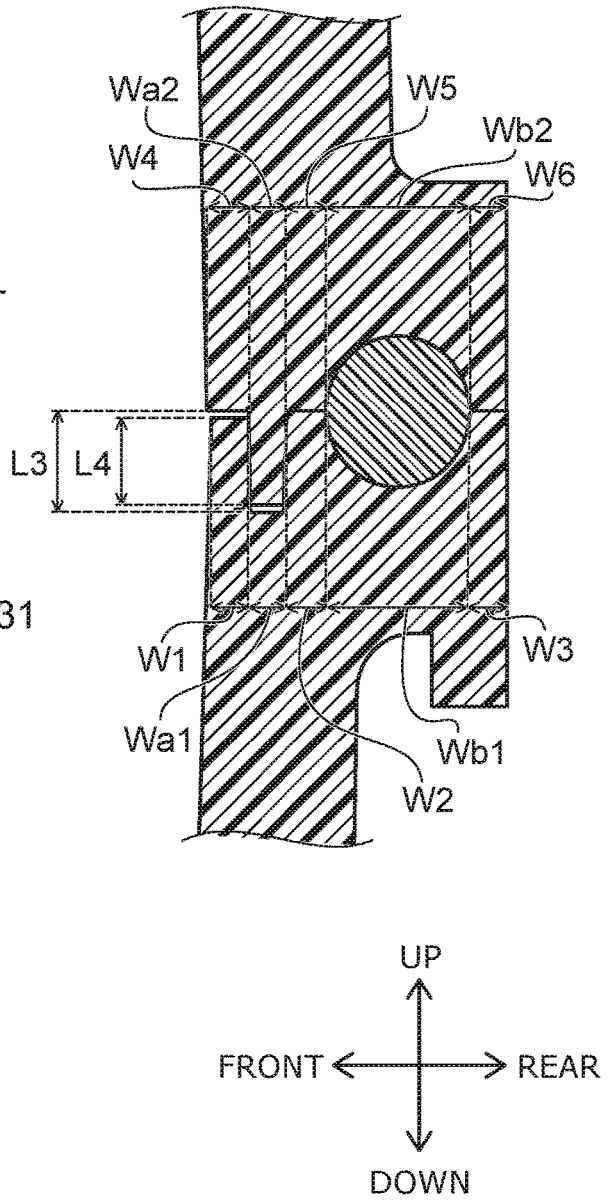

FIG. 5A and FIG. 5B are cross-sectional views schematically illustrating an enlargement of a part of the water storage tank according to the embodiment.

FIG. 4, FIG. 5A, and FIG. 5B are cross-sectional views of the bonding member vicinity on the rearward side when viewed from the left side.

As illustrated in FIG. 4, FIG. 5A, and FIG. 5B, the cross-sectional configurations of the first bonding part 36*a* and the second bonding part 37*a* are, for example, arcs. In the example, the cross-sectional configuration of the bonding member 33 is substantially a circle. The bonding member 33 may be fused with and bonded to parts of the first bonding part 36*a* and the second bonding part 37*a* when bonding.

As illustrated in FIG. 4, FIG. 5A, and FIG. 5B, the lower enclosure 31 also includes a first protruding part 31*d*. The first protruding part 31*d* is a part protruding away from the space 35 (the first inner surface 31*a*) (outward from the water storage tank 30) from an upper edge 31*e* of the first outer surface 31*b*. The first rim part 31*c* includes the upper end of the first protruding part 31*d*. In other words, a part of the first rim part 31*c* is positioned further outward on the water storage tank 30 than is the upper edge 31*e* of the first outer surface 31*b*.

On the other hand, the upper enclosure 32 includes a second protruding part 32*d*. The second protruding part 32*d* is a part protruding away from the space 35 (the second inner surface 32*a*) (outward from the water storage tank 30) from a lower edge 32*e* of the second outer surface 32*b*. The second rim part 32*c* includes the lower end of the second protruding part 32*d*. In other words, a part of the second rim part 32*c* is positioned further outward on the water storage tank 30 than is the lower edge 32*e* of the second outer surface 32*b*.

In the example, a part of the bonding member 33 is provided at the first protruding part 31*d* and the second protruding part 32*d*. In other words, the first bonding part 36*a* is provided to overlap the first protruding part 31*d*; and the second bonding part 37*a* is provided to overlap the second protruding part 32*d*. Also, the bonding member 33 is provided at a position overlapping an imaginary line IL connecting the upper edge 31*e* of the first outer surface 31*b* and the lower edge 32*e* of the second outer surface 32*b*.

As illustrated in FIG. 4, FIG. 5A, and FIG. 5B, the lower enclosure 31 also has a concave part 36*b* in the first rim part 31*c*. The concave part 36*b* is recessed downward. The concave part 36*b* is provided on the space 35 side of the bonding member 33 (inward in the water storage tank 30). In other words, the concave part 36*b* is positioned between the first bonding part 36*a* and the first inner surface 31*a*.

The upper enclosure 32 includes a convex part 37*b* in the second rim part 32*c*. The convex part 37*b* protrudes downward. The convex part 37*b* is provided on the space 35 side of the bonding member 33 (inward in the water storage tank 30). In other words, the convex part 37*b* is positioned between the second bonding part 37*a* and the second inner surface 32*a*.

The convex part 37*b* of the upper enclosure 32 is engaged with the concave part 36*b* of the lower enclosure 31. The concave part 36*b* and the convex part 37*b* are respectively provided to surround the peripheries of the opening of the lower enclosure 31 and the opening of the upper enclosure 32. In other words, the concave part 36*b* and the convex part 37*b* are engaged at the entire perimeters of the first rim part 31*c* of the lower enclosure 31 and the second rim part 32*c* of the upper enclosure 32.

As illustrated in FIG. 4, FIG. 5A, and FIG. 5B, the first rim part 31*c* of the lower enclosure 31 also includes first to third parts 36*c* to 36*e* in addition to the first bonding part 36*a* and the concave part 36*b* recited above. The first part 36*c* is positioned between the first inner surface 31*a* and the concave part 36*b*. The second part 36*d* is positioned between the concave part 36*b* and the first bonding part 36*a*. The third part 36*e* is positioned between the first bonding part 36*a* and the outer end of the first protruding part 31*d*. That is, the first part 36*c*, the concave part 36*b*, the second part 36*d*, the first bonding part 36*a*, and the third part 36*e* are provided in the first rim part 31*c* from the first inner surface 31*a* toward the outer end of the first protruding part 31*d*.

For example, a width W1 of the first part 36*c* and a width W2 of the second part 36*d* in the direction from the first inner surface 31*a* toward the outer end of the first protruding part 31*d* are substantially the same. Also, for example, a width W3 of the third part 36*e* is substantially the same as at least one of the width W1 or the width W2. Also, for example, a width Wa1 of the concave part 36*b* is substantially the same as at least one of the width W1, the width W2, or the width W3. In the example, the width W1, the width W2, the width W3, and the width Wa1 are substantially the same. The width Wa1 of the concave part 36*b* may decrease downward. In other words, the width of the cross section of the concave part 36*b* may have a tapered configuration becoming finer downward. In such a case, for example, the width Wa1 of the concave part 36*b* can be considered to be the width of the upper end of the concave part 36*b*. Also, a width Wb1 of the first bonding part 36*a* is, for example, larger than at least one of the width W1, the width W2, the width W3, or the width Wa1. In the example, the width Wb1 is larger than all of the width W1, the width W2, the width W3, and the width Wa1. Also, a length L3 in the vertical direction of the concave part 36*b* is, for example, longer than the total of the width W1, the width W2, and the width Wa1. In other words, the length L3 is longer than the distance between the upper edge of the first inner surface 31*a* and the bonding member 33 (the first bonding part 36*a*).

On the other hand, the second rim part 32*c* of the upper enclosure 32 includes fourth to sixth parts 37*c* to 37*e* in addition to the second bonding part 37*a* and the convex part 37*b* recited above. The fourth part 37*c* is positioned between the second inner surface 32*a* and the convex part 37*b*. The fifth part 37*d* is positioned between the convex part 37*b* and the second bonding part 37*a*. The sixth part 37*e* is positioned between the second bonding part 37*a* and the outer end of the second protruding part 32*d*. That is, the fourth part 37*c*, the convex part 37*b*, the fifth part 37*d*, the second bonding part 37*a*, and the sixth part 37*e* are provided in the second rim part 32*c* from the second inner surface 32*a* toward the outer end of the second protruding part 32*d*.

A width W4 of the fourth part 37*c* and a width W5 of the fifth part 37*d* in the direction from the second inner surface 32*a* toward the outer end of the second protruding part 32*d* are, for example, substantially the same. Also, a width W6 of the sixth part 37*e* is, for example, substantially the same as at least one of the width W4 or the width W5. Also, a width Wa2 of the convex part 37*b* is, for example, substantially the same as at least one of the width W4, the width W5, or the width W6. In the example, the width W4, the width W5, the width W6, and the width Wa2 are substantially the same. The width Wa2 of the convex part 37*b* may decrease downward. In other words, the width of the cross section of the convex part 37*b* may have a tapered configuration becoming finer downward. In such a case, for example, the width Wa2 of the convex part 37*b* can be considered to be the width of the upper end of the convex part 37*b*. Also, a width Wb2 of the second bonding part 37*a* is, for example, larger than at least one of the width W4, the width W5, the width W6, or the width Wa2. In the example, the width Wb2 is larger than all of the width W4, the width W5, the width W6, and the width Wa2. Also, a length L4 in the vertical direction of the convex part 37*b* is, for example, longer than the total of the width W4, the width W5, and the width Wa2. In other words, the length L4 is longer than the distance between the lower edge of the second inner surface 32*a* and the bonding member 33 (the second bonding part 37*a*).

The first part 36*c* opposes the fourth part 37*c* in the state in which the first rim part 31*c* of the lower enclosure 31 and the second rim part 32*c* of the upper enclosure 32 are bonded. For example, the width W1 of the first part 36*c* is substantially the same as the width W4 of the fourth part 37*c*. The second part 36*d* opposes the fifth part 37*d*. For example, the width W2 of the second part 36*d* is substantially the same as the width W5 of the fifth part 37*d*. The third part 36*e* opposes the sixth part 37*e*. For example, the width W3 of the third part 36*e* is substantially the same as the width W6 of the sixth part 37*e*. The convex part 37*b* is engaged with the concave part 36*b*. For example, the width Wa1 of the concave part 36*b* is substantially the same as the width Wa1 of the convex part 37*b*. The first bonding part 36*a* opposes the second bonding part 37*a*. For example, the width Wb1 of the first bonding part 36*a* is substantially the same as the width Wb2 of the second bonding part 37*a*.

In the example, the length L3 in the vertical direction of the concave part 36*b* is longer than the length L4 in the vertical direction of the convex part 37*b*. That is, a gap is provided between the lower end of the concave part 36*b* and the lower end of the convex part 37*b*. Also, in the example, a gap is provided between the first part 36*c* and the fourth part 37*c*. On the other hand, the second part 36*d* and the fifth part 37*d* are in contact. Also, the third part 36*e* and the sixth part 37*e* are in contact. As recited above, by providing the gap between the lower end of the convex part 37*b* and the lower end of the concave part 36*b* and between the first part 36*c* and the fourth part 37*c*, the second part 36*d* and the fifth part 37*d* can be in contact and the third part 36*e* and the sixth part 37*e* can be in contact more reliably without leaving gaps. Thereby, when the lower enclosure 31 and the upper enclosure 32 are pressed by the dies from the vertical direction in the secondary molding of the DSI molding, gaps do not occur easily at the peripheries of the first bonding part 36*a* and the second bonding part 37*a* (e.g., between the second part 36*d* and the fifth part 37*d* and between the third part 36*e* and the sixth part 37*e*).

A surface area S1 from the upper edge of the first inner surface 31*a* of the lower enclosure 31 to the first bonding part 36*a* (the bonding member 33) is larger than a surface area S2 of the first bonding part 36*a*. The surface area S1 is the total of the surface area of the first part 36*c*, the surface area of the second part 36*d*, and the surface area of the concave part 36*b*. Also, a surface area S3 from the lower edge of the second inner surface 32*a* of the upper enclosure 32 to the second bonding part 37*a* (the bonding member 33) is larger than a surface area S4 of the second bonding part 37*a*. The surface area S3 is the total of the surface area of the fourth part 37*c*, the surface area of the fifth part 37*d*, and the surface area of the convex part 37*b*.

For example, the water storage tank 30 is manufactured by DSI molding. In the manufacturing method using DSI molding, first, molding (preliminary molding) of the lower enclosure 31 and the upper enclosure 32 is performed by dies. Then, the dies slide to align the positions of the lower enclosure 31 and the upper enclosure 32; and the convex part 37*b* of the upper enclosure 32 is caused to engage with the concave part 36*b* of the lower enclosure 31. In this state, the lower enclosure 31 and the upper enclosure 32 are pressed together from the vertical direction; and a resin that is used to form the bonding member 33 is injected between the first bonding part 36*a* of the lower enclosure 31 and the second bonding part 37*a* of the upper enclosure 32 (secondary molding). When pressing the lower enclosure 31 and the upper enclosure 32 from the vertical direction, for example, the first protruding part 31*d* of the lower enclosure 31 and the second protruding part 32*d* of the upper enclosure 32 are pressed from the vertical direction. Also, when injecting the resin used to form the bonding member 33, for example, the resin that is used to form the bonding member 33 is injected from a gate provided in at least one of the first protruding part 31*d* or the second protruding part 32*d*. The injected resin becomes the bonding member 33 by curing; and the lower enclosure 31 and the upper enclosure 32 are bonded.

In the example, the arrangement of the hot water storage-type heat exchanger 20 is not limited to the hot water storage-type heat exchanger 20 being stored inside the casing 4 so that the opening of the lower enclosure 31 of the water storage tank 30 is upward. That is, the hot water storage-type heat exchanger 20 may be stored inside the casing 4 so that the opening of the lower enclosure 31 of the water storage tank 30 is toward any direction.

As described above, in the embodiment, the convex part 37*b* of the upper enclosure 32 is engaged with the concave part 36*b* of the lower enclosure 31 at a position on the space 35 side of the bonding member 33 (inward). Thereby, in the case where water pressure is applied from the tank interior (the space 35), the concentration of the stress at the bonding member 33 can be suppressed. Also, the length in the vertical direction of the lower enclosure 31 is shorter than that of the upper enclosure 32. Therefore, the rigidity of the lower enclosure 31 is higher than that of the upper enclosure 32. In the embodiment, by providing the concave part 36*b* in the lower enclosure 31 having the higher rigidity than the upper enclosure 32, the engaging part between the concave part 36*b* and the convex part 37*b* does not deform easily; and the concentration of the stress at the bonding member 33 can be suppressed further. Accordingly, the breakage of the bonding member 33 due to the water pressure from the tank interior (the space 35) can be suppressed; and the water leakage of the water storage tank 30 can be suppressed.

In the embodiment, the length L4 in the vertical direction of the convex part 37*b* is set to be longer than the distance between the bonding member 33 and the lower edge of the second inner surface 32*a* of the upper enclosure 32 (the total of the width W4 of the fourth part 37*c*, the width W5 of the fifth part 37*d*, and the width Wa1 of the convex part 37*b*). By setting the length L4 in the vertical direction of the convex part 37*b* to be long, the contact surface area between the convex part 37*b* and the concave part 36*b* increases; and the friction between the convex part 37*b* and the concave part 36*b* increases. Thereby, the engaging part between the concave part 36*b* and the convex part 37*b* deforms less easily. Therefore, the breakage of the bonding member 33 due to the water pressure from the tank interior (the space 35) can be suppressed further.

In the embodiment, the surface area S3 (the total of the surface area of the fourth part 37*c*, the surface area of the fifth part 37*d*, and the surface area of the convex part 37*b*) of the region from the lower edge of the second inner surface 32*a* of the upper enclosure 32 to the second bonding part 37*a* (the bonding member 33) (the region inward from the second bonding part 37*a*) is set to be larger than the surface area S4 of the second bonding part 37*a*. Curing occurs rapidly in the preliminary molding of the DSI molding when the surface area is large. Thereby, in the preliminary molding of the DSI molding, the region inward from the second bonding part 37*a* can be cured faster than the second bonding part 37*a*. Also, the density of the bonding member 33 that is injected can be set to be high. Accordingly, the breakage of the bonding member 33 due to the water pressure from the tank interior (the space 35) can be suppressed further.

In the case where the bonding member 33 is proximal to the interior of the water storage tank 30 (the space 35), the distance between the bonding member 33 and the engaging part between the concave part 36*b* and the convex part 37*b* is shorter. Accordingly, in the case where water pressure is applied from the tank interior, the stress that is applied to the bonding member 33 is small. On the other hand, in the case where the bonding member 33 is proximal to the exterior of the water storage tank 30, the bonding member 33 (the first bonding part 36*a* and the second bonding part 37*a*) easily overlaps the first protruding part 31*d* and the second protruding part 32*d*. Accordingly, when the first protruding part 31*d* and the second protruding part 32*d* are pressed by the dies from the vertical direction in the secondary molding of the DSI molding, gaps do not occur easily at the peripheries of the first bonding part 36*a* and the second bonding part 37*a* (e.g., between the second part 36*d* and the fifth part 37*d* and between the third part 36*e* and the sixth part 37*e*). That is, the deformation of the lower enclosure 31 and the upper enclosure 32 can be suppressed when injecting the resin used to form the bonding member 33 in the secondary molding of the DSI molding. Therefore, in the embodiment, for example, the bonding member 33 is provided at a position overlapping the imaginary line IL connecting the upper edge 31*e* of the first outer surface 31*b* of the lower enclosure 31 and the lower edge 32*e* of the second outer surface 32*b* of the upper enclosure 32. Thereby, a good balance can be achieved between the reduction of the stress applied to the bonding member 33 when water pressure is applied from the tank interior and the suppression of the deformation of the lower enclosure 31 and the upper enclosure 32 when injecting the bonding member 33 in the secondary molding of the DSI molding.

Also, in the embodiment, the hot water storage-type heat exchanger 20 that includes the water storage tank 30 recited above and includes the heater 40 heating the water inside the water storage tank 30 is provided. Thereby, the hot water storage-type heat exchanger 20 can be provided in which water leakage caused by breakage of the bonding member 33 of the water storage tank 30 is suppressed.

Also, in the embodiment, the sanitary washing device 1 that includes the hot water storage-type heat exchanger 20 recited above and includes the casing 4 storing the hot water storage-type heat exchanger 20 is provided. Thereby, the sanitary washing device 1 can be provided in which water leakage outside the casing 4 caused by the breakage of the bonding member 33 of the water storage tank 30 is suppressed.

Hereinabove, embodiments of the invention are described. However, the invention is not limited to these descriptions. Appropriate design modifications made by one skilled in the art for the embodiments described above also are within the scope of the invention to the extent that the features of the invention are included. For example, the configurations, the dimensions, the materials, the arrangements, etc., of the components included in the sanitary washing device 1, the hot water storage-type heat exchanger 20, the water storage tank 30, etc., are not limited to those illustrated and can be modified appropriately.

The components included in the embodiments described above can be combined within the limits of technical feasibility; and such combinations also are within the scope of the invention to the extent that the features of the invention are included.

What is claimed is:

1. A water storage tank having a space in an interior of the water storage tank, water being stored in the space, the tank comprising:

a lower enclosure;

an upper enclosure positioned on the lower enclosure, the space being formed by the upper enclosure being bonded to the lower enclosure, the upper enclosure being longer than the lower enclosure in a vertical direction; and a bonding member bonding the lower enclosure and the upper enclosure and being positioned between the lower enclosure and the upper enclosure, the lower enclosure having a concave part provided on the space side of the bonding member, the upper enclosure having a convex part provided on the space side of the bonding member, the convex part being engaged with the concave part.

2. The tank according to claim 1, wherein a length in the vertical direction of the convex part is longer than a distance between the bonding member and a lower edge of an inner surface of the upper enclosure.

3. The tank according to claim 1, wherein the upper enclosure includes a bonding part to be bonded to the bonding member, and a surface area from a lower edge of an inner surface of the upper enclosure to the bonding part is greater than a surface area of the bonding part.

4. The tank according to claim 1, wherein the lower enclosure includes a first protruding part protruding away from the space from an upper edge of an outer surface of the lower enclosure, the upper enclosure includes a second protruding part protruding away from the space from a lower edge of an outer surface of the upper enclosure, and the bonding member overlaps an imaginary line connecting the upper edge of the outer surface of the lower enclosure and the lower edge of the outer surface of the upper enclosure.

5. A hot water storage-type heat exchanger, comprising:

the water storage tank according to claim 1; and a heater heating the water inside the water storage tank.

6. A sanitary washing device, comprising:

the hot water storage-type heat exchanger according to claim 5; and a casing storing the hot water storage-type heat exchanger.

* * * * *